United States Patent [19]

Carroll

[11] Patent Number: 4,583,258

[45] Date of Patent: Apr. 22, 1986

[54] FLUE CLEANER AND MOUNTING ATTACHMENT

[76] Inventor: Roger W. Carroll, 1029 E. Prairie St., Jerseyville, Ill. 62052

[21] Appl. No.: 629,583

[22] Filed: Jul. 11, 1984

[51] Int. Cl.[4] ..... F23J 3/00

[52] U.S. Cl. ..... 15/249; 15/243

[58] Field of Search ..... 15/163, 243, 249, 242; 126/16; 166/170

[56] References Cited

U.S. PATENT DOCUMENTS 4,365,382 12/1982 Korfmann et al. ..... 15/249
4,409,703 10/1983 Marcellus ..... 15/243 X

FOREIGN PATENT DOCUMENTS 157732 12/1982 Fed. Rep. of Germany ..... 15/243
25637 of 1910 United Kingdom ..... 15/249
29791 of 1910 United Kingdom ..... 15/249

*Primary Examiner*—Chris K. Moore
*Attorney, Agent, or Firm*—Harvey B. Jacobson

[57] ABSTRACT

Flue cleaning apparatus comprises a bladed scraper head suspended by cable in a flue from pulleys on a mounting attachment secured at the top of the flue so that the cable can be operated from outside of a building of which the flue forms a part, to move the scraper head up and down in the flue for cleaning creosote and like deposits from the surfaces thereof. The scraper head incorporates alignment blades for guiding the scraper head off of irregularities which might be present in a flue, and a movable weight which can be used to hammer against the scraper head should it become lodged in a flue thereby assisting in dislodging same.

7 Claims, 5 Drawing Figures

FLUE CLEANER AND MOUNTING ATTACHMENT

BACKGROUND OF THE INVENTION

This invention relates to apparatus for use in scraping creosote and like deposits off of the surfaces of chimney flues.

It is known to provide flue-cleaning apparatus in the form of a scraper head, having peripheral scraping or cutting blades, or the like, and which is suspended in a flue by cable or the like from a pulley block mounted at the top of the flue. The cable may extend down the outside of the building on which the flue is situated for external operation, so that pulling on the cable causes the scraper head to be drawn up the flue to cut or scrape creosote and like deposits from the flue surfaces.

One problem which may arise with flue-scraping apparatus of the above type, is that the flue surfaces, and/or the creosote deposits may have irregularities against which the scraper head may snag as it is drawn along the flue, thereby obstructing or possibly preventing further progress thereof. The present invention provides, inter alia, a form of flue-scraper head, particularly designed to avoid snagging when encountering irregularities as aforesaid, and/or having means for assisting in dislodging the scraper head, should it become lodged in a flue.

STATEMENT OF PRIOR ART

Examples of previous proposals relating to flue scraping apparatus are shown in the following U.S. Pat. Nos. None of these, however, has the features of the present invention.

U.S. Pat. No. 1,315,849
U.S. Pat. No. 1,398,155
U.S. Pat. No. 1,777,815
U.S. Pat. No. 2,455,001
U.S. Pat. No. 4,028,769
U.S. Pat. No. 4,340,989
U.S. Pat. No. 4,365,382

SUMMARY OF THE INVENTION

The invention provides flue cleaning apparatus which comprises a scraper head, and a mounting attachment for suspending the scraper head in a chimney flue by means of a cable or the like, the mounting attachment having pulley means over which a cable suspending the scraper head is passed so that the cable can be manipulated externally of the flue to move the scraper head up and down in the flue, the scraper head being formed with peripheral scraper or cutter blades with top and bottom cutting edges, and also with inwardly inclined alignment blades extending above and below the respective top and bottom cutting edges, for guiding the head off of flue irregularities as it is moved along the flue to scrape creosote and like deposits from the surfaces thereof. The cutter blades may be formed in a rectangular box-like configuration and the head may have a central weight or hammer attached to the cable and which is movably mounted with respect to the scraper blades on a crossbar or the like, whereby the weight may be used to hammer against the crossbar, by pulling on the cable, should the scraper head become lodged in a flue, so as to assist in dislodging thereof.

The alignment blades may be welded top and bottom to the cutter blades, and the mounting attachment may be designed in the form of an adjustable strap for embracing around the top of a flue, with a pair of pulleys for the cable on respective crossbars, or the like, connected between opposite sides of the strap with one of the pulleys being centralized over the flue opening and the other pulley being located externally thereof to allow the cable to be manipulated from externally of a building of which the flue forms a part.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 1:
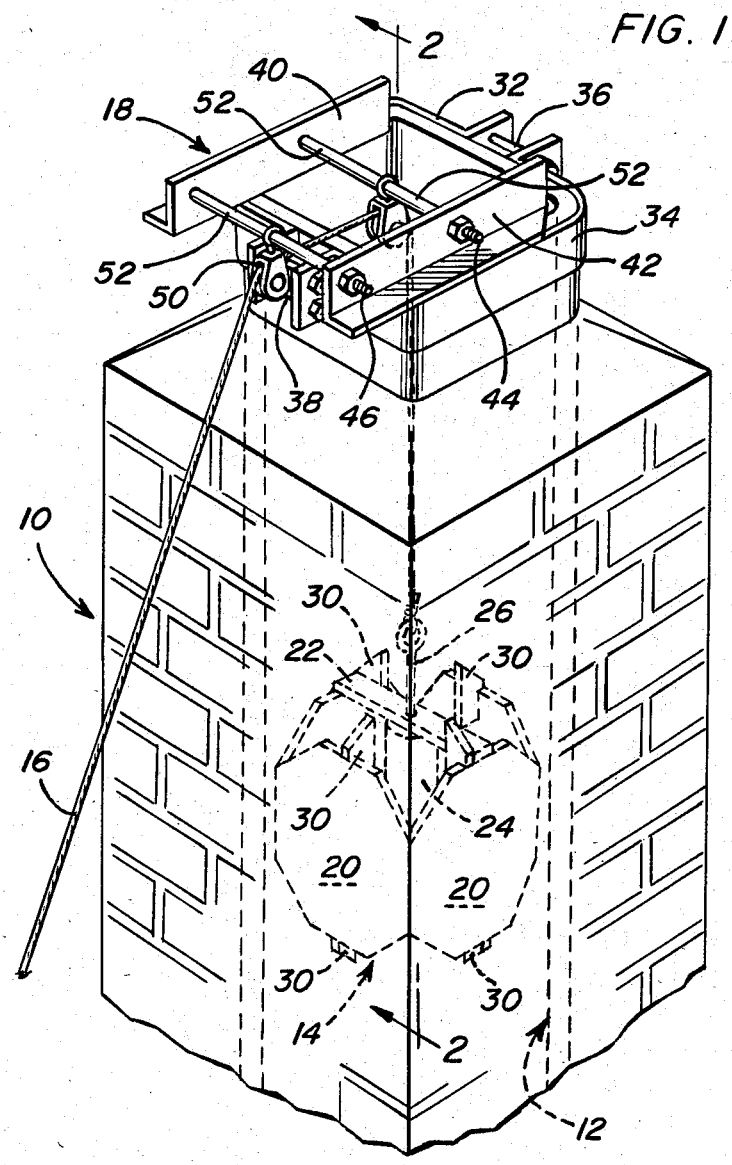
FIG. 1 is a perspective view of a chimney fitted with flue-cleaning apparatus in accordance with the invention.
Figure 4:
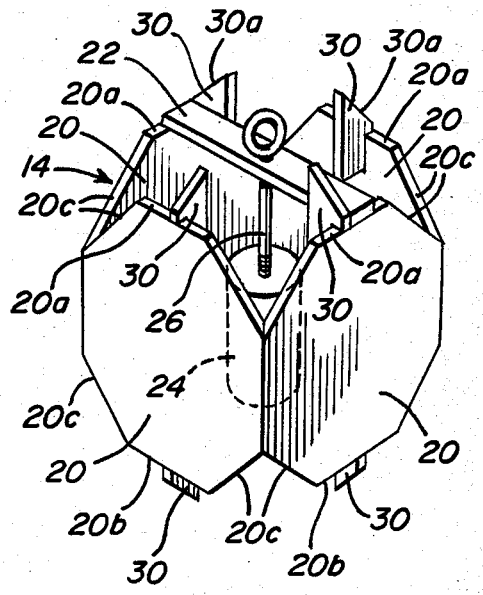
FIG. 4 is a perspective view of a scraper head portion of the flue-cleaning apparatus.
Figure 5:
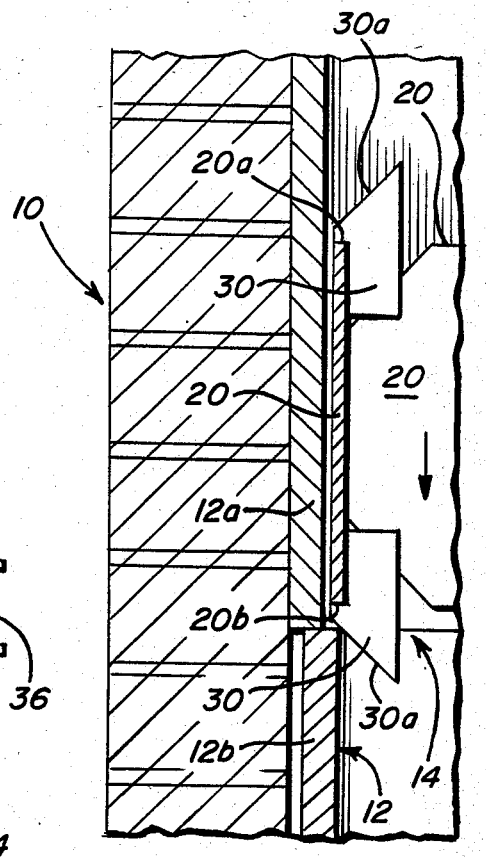
FIG. 5 is an enlarged sectional view similar to FIG. 2 showing the scraper head negotiating a part of a flue liner having an irregularity therein.
Figure 3:
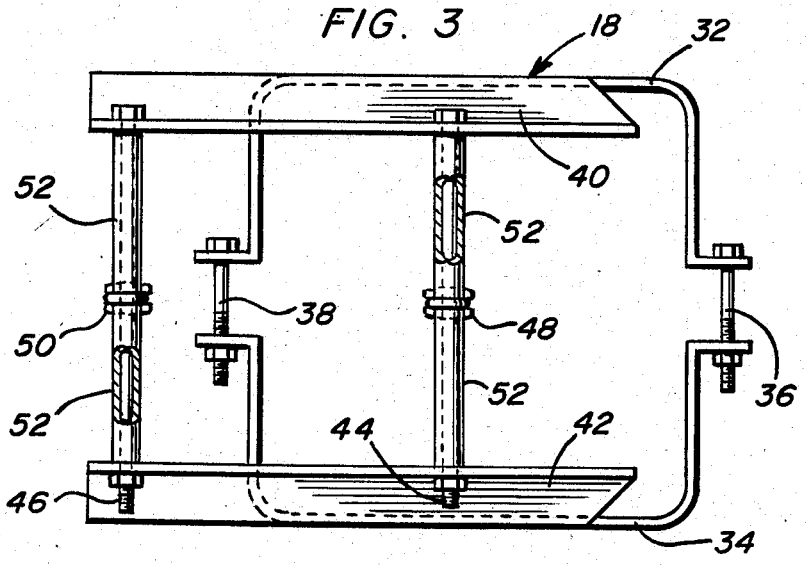
FIG. 3 is an enlarged plan view of a mounting attachment portion of the flue-cleaning apparatus.
Figure 2:
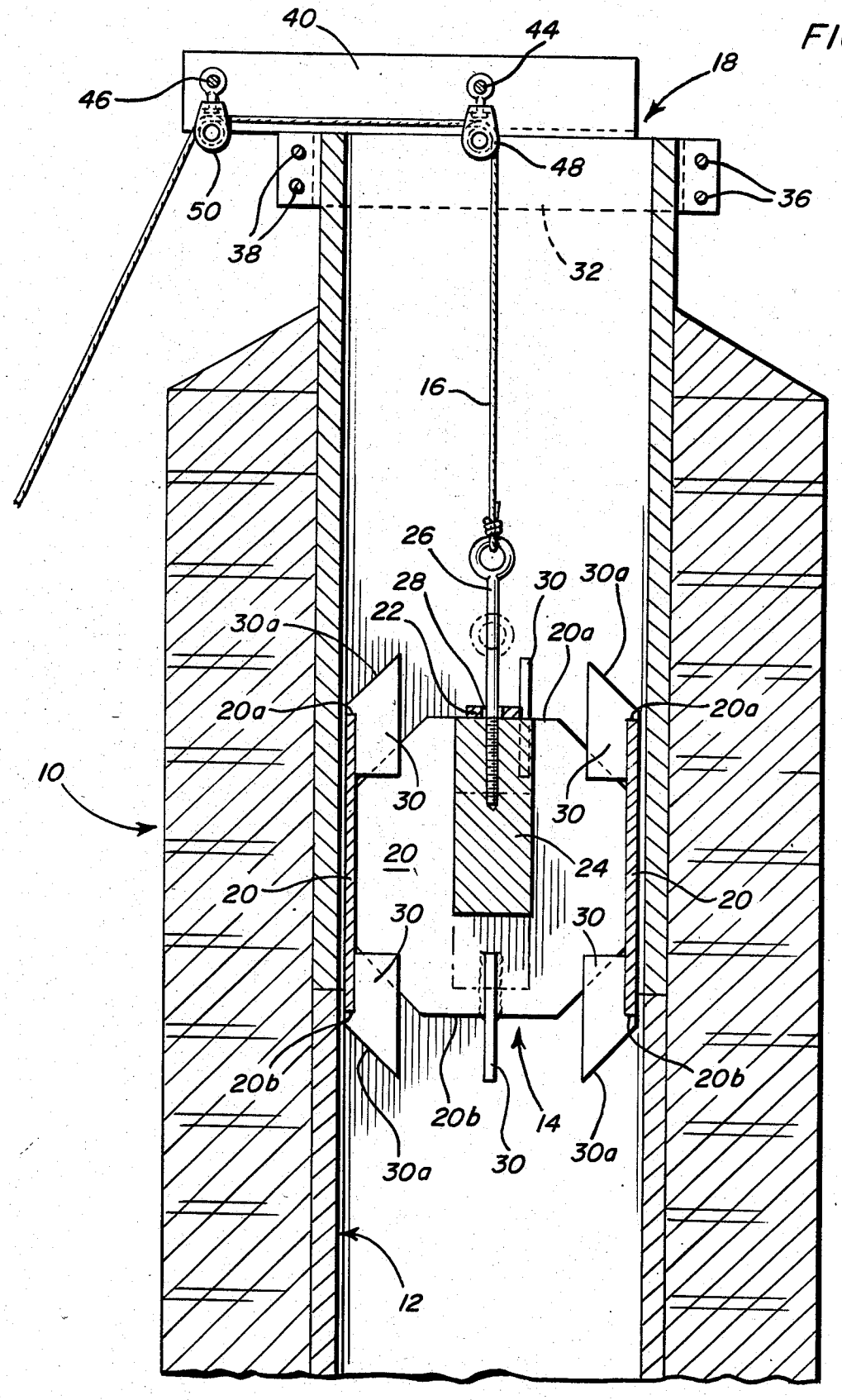
FIG. 2 is an enlarged sectional view on line 2—2 of FIG. 1.

As shown more particularly in FIGS. 1, 2 and 5, a brick chimney 10 with a conventional form of flue liner 12 is provided with flue-cleaning apparatus in accordance with the invention comprising a scraper head 14 which is suspended by a cable 16 from a mounting attachment 18 affixed at the top of the chimney.

Scraper head 14 comprises four generally rectangular scraper blades 20 welded edge-to-edge to form a box-like structure with a crossbar 22 welded across the top to form a handle and also a support for a central weight 24 attached to an eyebolt 26 loosely received in a central hole 28 formed in the crossbar, the eyebolt providing an attachment for cable 16. The upper and lower edges **20*a* and 20*b* of the respective cutter blades form cutting edges for scraping creosote or like deposits from the surfaces of the flue liner as the scraper head is moved up-and-down in the flue as will be described, and the corners 20*c* of the cutter blades may be beveled as shown (or may be rounded) to prevent damage to the flue wall. The scraper head is further provided with alignment blades 30 welded at the top and bottom of the respective cutter blades. The alignment blades have inclined outer surfaces 30*a* which serve to guide the scraper head off of any irregularities which may be encountered in the flue liner or the creosote deposit, as the scraper head moves up or down the flue. As shown, for example, in FIG. 5 the liner 12 may have slightly misaligned sections 12*a* and 12*b*. When moving down the flue, the scraper head might tend to lodge on the top of the lower section, except that it is guided away by engagement therewith of one of the lower alignment blades as illustrated. The upper alignment blades are similarly useful when the scraper head moves up the flue. Should the scraper head, however, become lodged in the flue, it may be jarred loose by hammering weight 24 against the crossbar 22, using an up and down pulling movement on cable 16**.

Mounting attachment 18 comprises a pair of channel-shaped frame members 32, 34 interconnected by bolt-and-nut connectors 36, 38 so as to form an adjustable strap which can be tightened around the top of the chimney. Welded to the respective frame members are angle irons 40, 42, and crossbolts 44, 46 are fitted between the angle irons. Pulleys 48, 50 for cable 16 are carried by the respective crossbolts, with spacer sleeves 52 centralizing the pulleys lengthwise of the bolts. The positioning of the crossbolts is such that pulley 48 is centralized over the top of the flue, while pulley 50 is outside of the flue. This facilitates guidance of the cable so that it can be operated externally of a building of which the chimney forms a part. Thus, the cable can be manipulated to raise and lower the scraper head along the flue expeditiously to remove creosote and like deposits from the flue liner, with the weight and alignment blade structure incorporated in the scraper head serving to minimize the possibility of snagging on any flue irregularities or lodging of the scraper head in the flue.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A scraper head structure for use in cleaning the interior surfaces of chimney flues and the like comprising a body member with peripheral scaper means, a weight, mounting means connecting the weight to the body for vertical movement of the weight relative to the body, and suspension means for connecting the weight to a suspension cable, whereby the cable can be used to raise and lower the scraper head in a flue, and also to raise and lower the weight relative to the body member should the scraper head become lodged in the flue so as to provide a hammering action of the weight against a part of the body member for dislodging the scraper head, wherein the scraper means comprises scraper blades provided with upper and lower scraping edges and wherein the scraper head includes inclined alignment blades at the top and bottom of the respective scraper blades for engaging obstructions encountered by the scraper head when traversing a flue and guiding the scraper head off of the obstructions.

2. The invention of claim 1 wherein the body member comprises a hollow box-like structure defining the scraper means, with a crossbar extending between opposite sides thereof to form the mounting means, and wherein the weight is provided with an eyebolt extending loosely through a hole in the crossbar, with the eye of the bolt forming the suspension means.

3. A scraper head structure for use in cleaning the interior surface of chimney flues and the like comprising a body with peripheral scraper means, suspension means for suspending the body in a flue from a cable whereby the cable can be used to move the scraper head up and down the flue to scrape the surfaces thereof, and the body further including peripheral alignment means for engaging obstructions in said surfaces and guiding the scraper head off of same, wherein the body comprises peripheral scraper blades with upper and lower scraping edges defining said scraper means, and wherein the alignment means comprises upper and lower alignment blades with inclined alignment surfaces extending from the top and bottom of the respective scraper blades.

4. The invention of claim 3 wherein the suspension means includes a movable weight carried on a crossbar extending between opposite ones of the scraper blades, the weight having means for connecting same to the cable, whereby the weight can be used for hammering against the crossbar should the scraper head become lodged in the flue.

5. Flue scraping apparatus comprising a scraper head, a suspension cable for suspending the scraper head in a flue to be cleaned, and a mounting attachment for securing at the top of the flue, the mounting attachment including first and second pulleys for receiving the cable, and means positioning the first pulley substantially centrally over the flue, and the second pulley outside of the flue whereby the cable can be manipulated to move the scraper head up and down the flue from externally of a building of which the flue forms a part, wherein the scraper head comprises a box-like structure formed from peripheral scraper blades, and alignment blades for guiding the scraper head off of obstructions encountered in passage through the flue, the alignment blades being connected top and bottom to the respective scraper blades.

6. The invention of claim 5 wherein the mounting attachment comprises an adjustable strap means for peripherally embracing around the top of the flue, a pair of supports connected to opposite sides of the strap means, and cross members between the supports for mounting the respective pulleys.

7. The invention of claim 5 wherein the scraper head includes a weight connected to the cable and movably retained in a support member forming a part of the box-like structure so that the weight may be used for hammering against the support member should the scraper head become lodged in a flue.

* * * * *